US005146995A

United States Patent [19]

Kim

[11] Patent Number: 5,146,995

[45] Date of Patent: Sep. 15, 1992

[54] OIL WELL FIRE EXTINGUISHER HAVING UPPER AND LOWER EXTERNAL FLAME RETARDANT-DISPERSING RINGS

[75] Inventor: Hilton S. Kim, Los Angeles, Calif.

[73] Assignee: Hilton & Chris Enterprises, Los Angeles, Calif.

[21] Appl. No.: 696,234

[22] Filed: May 6, 1991

[51] Int. Cl.[5] ..... A62C 3/06; A62C 2/04

[52] U.S. Cl. ..... 169/48; 169/52; 169/69

[58] Field of Search ..... 169/69, 43, 46, 47, 169/48, 52

[56] References Cited

U.S. PATENT DOCUMENTS

| | | | |
|---|---|---|---|
| 1,520,288 | 12/1924 | Featherstone | 169/69 X |
| 1,807,498 | 5/1931 | Teed | 169/49 X |
| 2,082,216 | 6/1937 | Patton | 169/69 X |
| 2,096,970 | 10/1937 | Lesh | 169/69 X |
| 3,887,011 | 6/1975 | Dokes et al. | 169/69 |
| 4,194,570 | 3/1980 | Arencibia, Jr. | 169/46 |
| 4,337,831 | 7/1982 | Thaxton | 169/69 |
| 4,433,733 | 2/1984 | Cunningham | 169/49 |
| 4,899,827 | 2/1990 | Poole | 169/69 |

FOREIGN PATENT DOCUMENTS 1062534 3/1967 United Kingdom ..... 169/69

*Primary Examiner*—Margaret A. Focarino
*Assistant Examiner*—Andrew C. Pike
*Attorney, Agent, or Firm*—John Holtrichter, Jr.

[57] ABSTRACT

A system, for extinguishing flames from combustible fluids exiting from a pipe, has an elongated tubular extinguisher body being disposable over the fluid emitting pipe, the extinguisher body having a lower inlet end and an upper outlet end and the body being adapted to accommodate a flow of the combustible fluid through the extinguisher body. A valve arrangement is mounted in the extinguisher body adjacent its upper outlet end for gradually limiting and finally eliminating the flow of the combustible fluid through the extinguisher body. Also, a flame inhibiting structure, including circular nozzle structures, are disposed adjacent the lower inlet end of the body and adjacent the valve arrangement and externally of the extinguisher body for preventing the support of combustion of combustible fluids adjacent the circular nozzle structures.

22 Claims, 5 Drawing Sheets

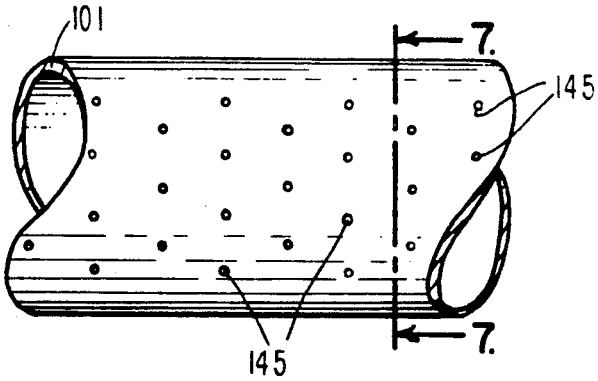
Fig. 6.
Fig. 7.
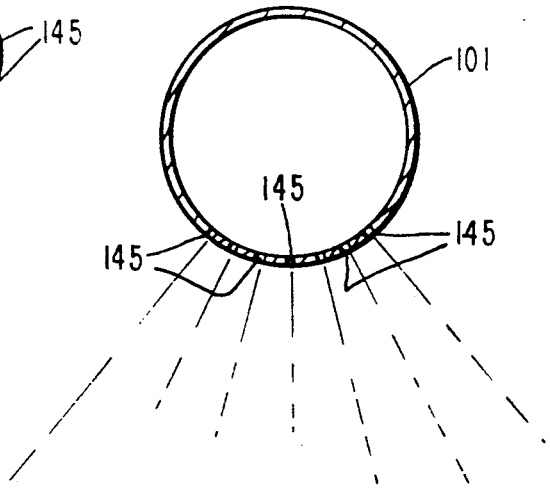
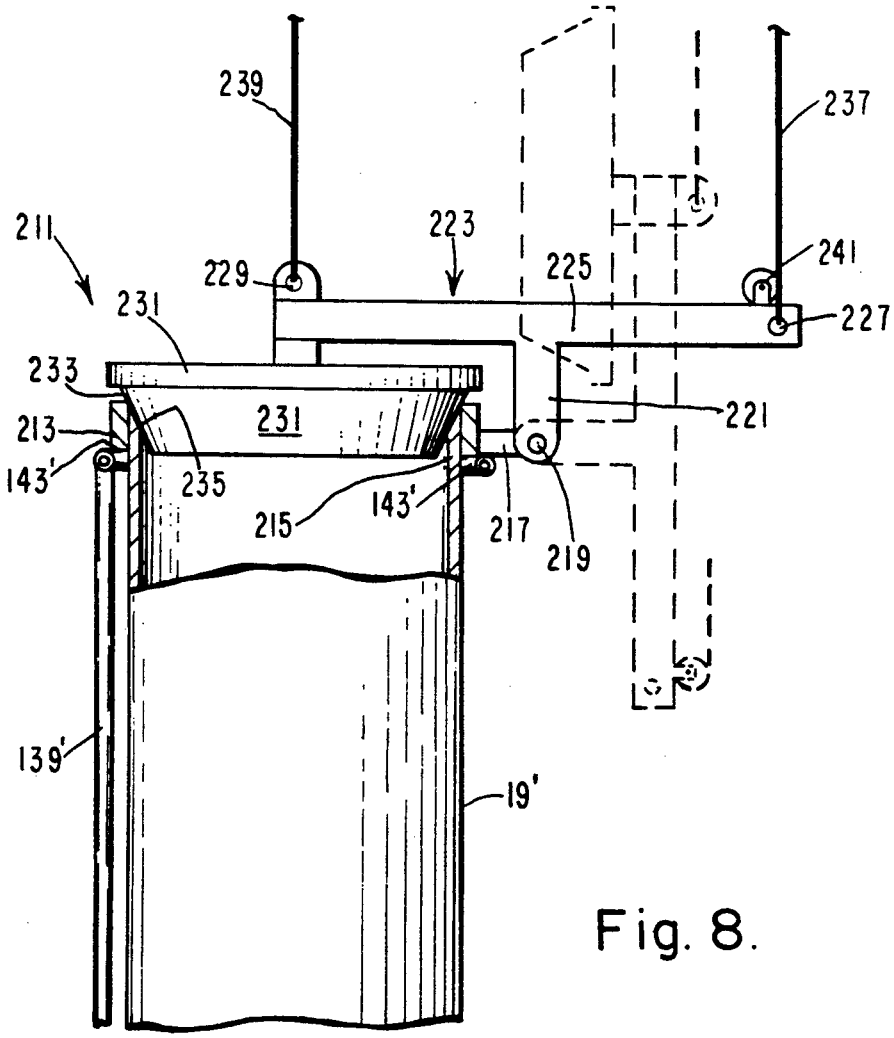
Fig. 8.

OIL WELL FIRE EXTINGUISHER HAVING UPPER AND LOWER EXTERNAL FLAME RETARDANT-DISPERSING RINGS

BACKGROUND

The present invention relates to fire extinguishing apparatus and more particularly to a system for extinguishing fires consuming combustible liquids or gases issuing from conduits such as pipes, gas wells, and the like.

The danger of accidental combustion of combustible liquids and gases has been recognized for many years. These fires have occurred with some frequency ever since the first oil and natural gas wells were drilled. The problem has become particularly acute with the advent of drilling techniques which allowed deeper wells which tapped combustible fluids under greater pressure.

After careful consideration of the above-noted problems and prior art solutions, the inventor herein has invented a new and improved fire extinguishing system that may be lifted and disposed over a flaming well, for example, which system includes an elongated tubular structure or body having a relatively wide lower opening to accommodate a wide variety of fire intensities, a unique valve arrangement at its uppermost extremity, and a fire retardant material exhausting structure adjacent its lower extremity. Intermediate the ends of the tubular body is a gradually reduced diameter section which causes a vacuum state at the bottom of the elongated body in order to pull the fire retardant material into the elongated cylinder and thereby prevent combustion from occurring or continuing within the cylinder. The invention is first configured to allow the full force of the flaming gushing fluids to flow through the structure before commencing the flooding of the lower area adjacent the ground with fire retardant material to prevent oxygen from supporting any combustion of the emanating combustible fluid. The valve mechanism is then gradually closed to divert the fluid back through the tubular body which acts as a pressure muffler at this point. The prior art has been investigated to determine the techniques that have been developed to overcome the above noted problems, prior to the present invention. For example, in U.S Pat. No. 1,520,288 a device is disclosed for extinguishing fires in oil wells that is adapted to fit over the mouth of a well and carries chemicals for extinguishing the flames with means for forcing the chemicals from it after it is put in place. The device includes a cone-shaped body which is formed of boiler plate or the like, with inner and outer walls forming a chamber, and has an upper outlet pipe to allow some of the pressure created by the burning oil or gas to escape while the same is being put in position and thus facilitate the placing of the device over the well. The inner wall of the body has a plurality of openings which are closed by plugs of soft material so that when steam, air, or water is forced into the chamber between the double walls, the soft plugs will be expelled and the chemicals driven from the chamber against the flames to extinguish the same.

U.S. Pat. No. 1,807,498 shows a well capping device adapted for use in capping gushing oil or gas wells. The device includes a bell-shaped cap having an outlet pipe, cement or other adhesive material inlet pipes, and an inner chamber defining lip structure. The cap is placed over a well casing and the area is sealed with cement or the like through a feed line pipe, while the force of the well is allowed to vent through the discharge pipe. A valve is provided at the top of the discharge pipe so that when any fire exciting from an upper fire pipe extending upwardly from the valve is extinguished by the closing of this fire pipe valve, valves in two horizontal lead-off pipes may be opened to provide paths for the oil to flow to storage facilities.

U.S. Pat. No. 2,082,216 discloses a fire extinguishing apparatus that basically consists of a pipe having a control valve, an upper outlet end, and a lower end that is shaped to telescope with the upper end of a well pipe. The pipe is swung over the well while the well is burning and is then lowered into telescopic relation with the upper end of the pipe. In order to protect the workmen from intense heat, a shield is secured around the pipe. Also, a pipe clamp is provided in order to secure the pipe onto the well pipe. The shield is positioned at an angle to deflect flames away from workmen, who can close the valve once the joint at the clamp is cemented securely by the flow of such material into the joint by opening a supply valve leading to an inlet pipe.

U.S. Pat. No. 2,096,970 involves a means and method for extinguishing oil well fires, and includes an elongated conduit capable of conducting water under pressure, a lower end for fitting on top of a well pipe, a water feed pipe with joints for providing the water to the interior of the conduit or pipe, an upper hole, and a slot in the upper portion of the pipe fitted with a pulley for lowering a conventional explosive torpedo toward the bottom of the pipe for exploding when it is in a proper position.

U.S. Pat. No. 3,887,011 shows a fire extinguisher for extinguishing an oil well fire that has a first pipe connectable to a well pipe and a second pipe branched from the first pipe in saguaro-like fashion. The first pipe is provided with a normally open first valve and a second flap-valve, while a normally-closed third valve is provided in the second pipe. The valves are coupled together by a linkage arrangement to provide a particular operation. Also, hooks are fabricated from meltable material such as lead which melt when heated sufficiently to produce certain unattended functions designed to extinguish a fire. In order to extinguish a fire, this apparatus first closes off the upper valve where the flame exists, at which time the fluid in the apparatus is diverted by the valving to the horizontal pipe leading to a storage tank, for example.

U.S. Pat. No. 4,194,570 covers a flow momentum reversing fire abatement system for extinguishing fires in well, pipes, or vent stacks. The apparatus comprises an extinguisher body having an inlet end and an outlet end that has a cylindrical passageway or bore from the inlet to the outlet ends. The inlet and outlet ends are adapted to be coupled in a fluid tight connection with the opposing ends of a combustible fluid pipe. A diffuser cone is disposed within the extinguisher body bore in coaxial alignment with the apex towards the outlet end of the extinguisher body. An extinguisher fluid nozzle is mounted within the body bore pointed at the top of the diffuser cone. Carbon dioxide, nitrogen, or helium may be used as an extinguishing fluid flowing through the nozzle.

U.S. Pat. No. 4,337,831 is a fire extinguishing apparatus for oil wells that has a plurality of containers that contain fire extinguishing material under pressure and that are connected to a main fire extinguishing container. The main container has a conduit leading from a valve in the neck thereof to the interior of a bell nipple positioned on an oil well blow out preventor. The valve has a vertically reciprocatable plunger therein, which when actuated downwardly permits free flow of the fire extinguishing material contained in the several containers to flow through a valve outlet leading to the bell nipple.

U.S. Pat. No. 4,433,733 shows an oil storage tank extinguisher or snuffer for putting out fires in oil tanks or oil wells which consists of a framework made from vertical members which are joined together at the bottom by a circular frame member and at the top by a similar frame member. The frame is designed to withstand fire for a sufficient period of time to extinguish the fire and is covered by a flexible material such as asbestos having cylindrical side walls and a top. A fire retardant fluid may be injected within the snuffer if desired by means of nozzles, for example. If there is an excessive build up of liquid within the chamber, it can be drawn off through a line.

And U.S. Pat. No. 4,899,827 discloses an oil well fire control system by injecting pressurized carbon dioxide, nitrogen, or monoammonia phosphate, into the flow of hydrocarbons from the drill pipe and casing through a spool apparatus located above the casing. Untreated water may be used as a back-up fluid after the chemicals have been dissipated.

From the foregoing it should be clear that none of the prior art techniques provide the adjustable valve/fire retardant flooding combination technique of the invention. Thus, it should be recognized that a fire extinguishing apparatus that is relatively easily positioned over even a very high pressure gushing and flaming oil well and the like before applying a combination of its features that quickly extinguishes all flames that exist at the well site and prevents re-ignition, constitutes an important advancement in the art.

SUMMARY OF THE INVENTION

In view of the foregoing factors and conditions characteristic of the prior art, it is a primary objective of the present invention to provide a new and improved fire extinguishing system that is particularly advantageously applied to the problem of extinguishing oil and gas well fires emanating from high pressure wells.

In accordance with an embodiment of the present invention, an extinguishing system for extinguishing flames from combustible fluids exiting from a pipe such as an oil or gas well casing includes an elongated tubular extinguisher body disposable over a combustible fluid emitting pipe, the extinguisher body having a lower inlet end and an upper outlet end and is adapted to accommodate the entire flow of combustible fluid through the extinguisher body. The invention also includes valve means mounted in the extinguisher body adjacent the upper outlet end for eliminating the flow of the combustible fluid through the extinguisher body. Further, the invention includes flame inhibiting means including circular nozzle structures disposed adjacent the lower inlet end and adjacent the valve means, externally of the extinguisher body, for preventing the support of combustion around and below the extinguisher body's lower inlet end and around and adjacent the valve means.

According to a presently preferred embodiment of the invention, the valve means includes a conical valve member and an associated annular valve seat disposed within the tubular body adjacent the top thereof. Alternately, a flapper valve configuration may be utilized where combustible fluid pressure flowing through the tubular body is not extremely high.

Thus, the present invention provides a new approach to contain and extinguish oil and gas well fires that is easily movable to a flaming oil well fire site and disposable thereon to extinguish the flame.

BRIEF DESCRIPTION OF THE DRAWINGS

The various features and advantages of the present invention may be more readily understood with reference to the following detailed description taken in conjunction with the accompanying drawings, wherein like reference characters relate to like elements, and in which:

FIG. 6 is an enlarged view of a portion of the ring of FIG. 4;

FIG. 7 is a cross sectional view of the portion of the ring taken along the line 7—7 shown in FIG. 6;

FIG. 8 is an enlarged view of valve arrangement constructed in accordance with another embodiment of the present invention;

DETAILED DESCRIPTION

Figure 3:
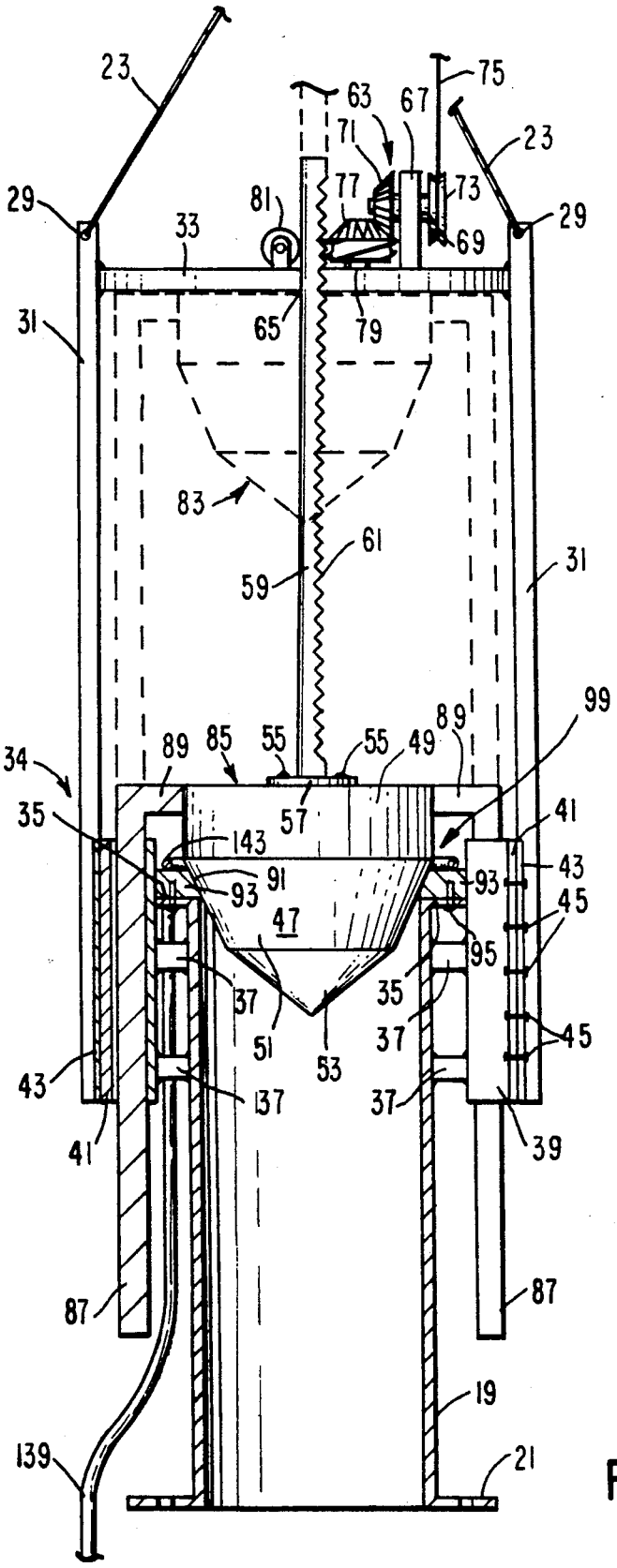
FIG. 3 is an enlarged view, partially broken away, of the upper cross section of the oil well fire extinguishing system shown in FIG. 2.
Figure 1:
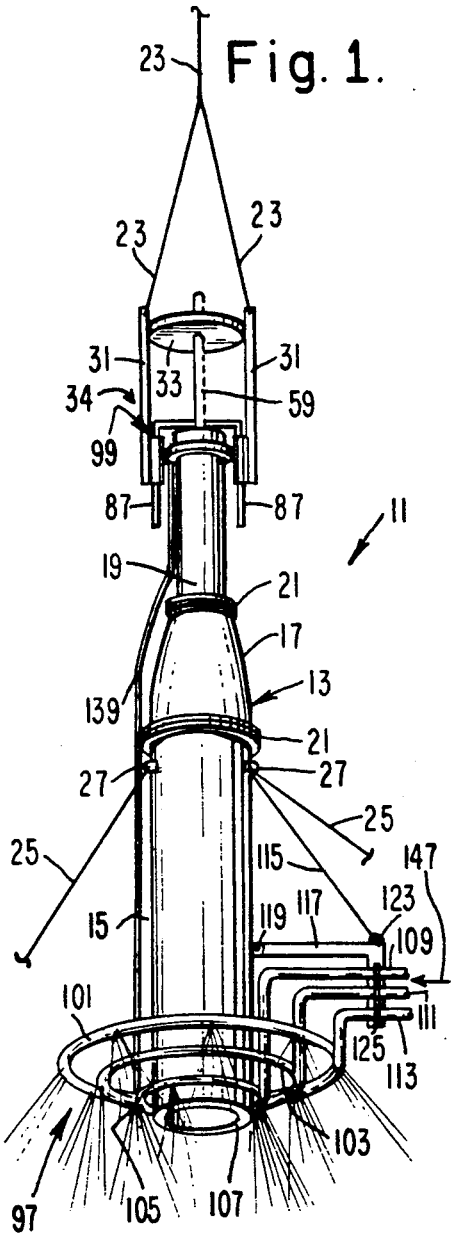
FIG. 1 is a perspective view of an extinguishing system for extinguishing flames from combustible fluids exiting from a vertical pipe, in accordance with the present invention.
Figure 2:
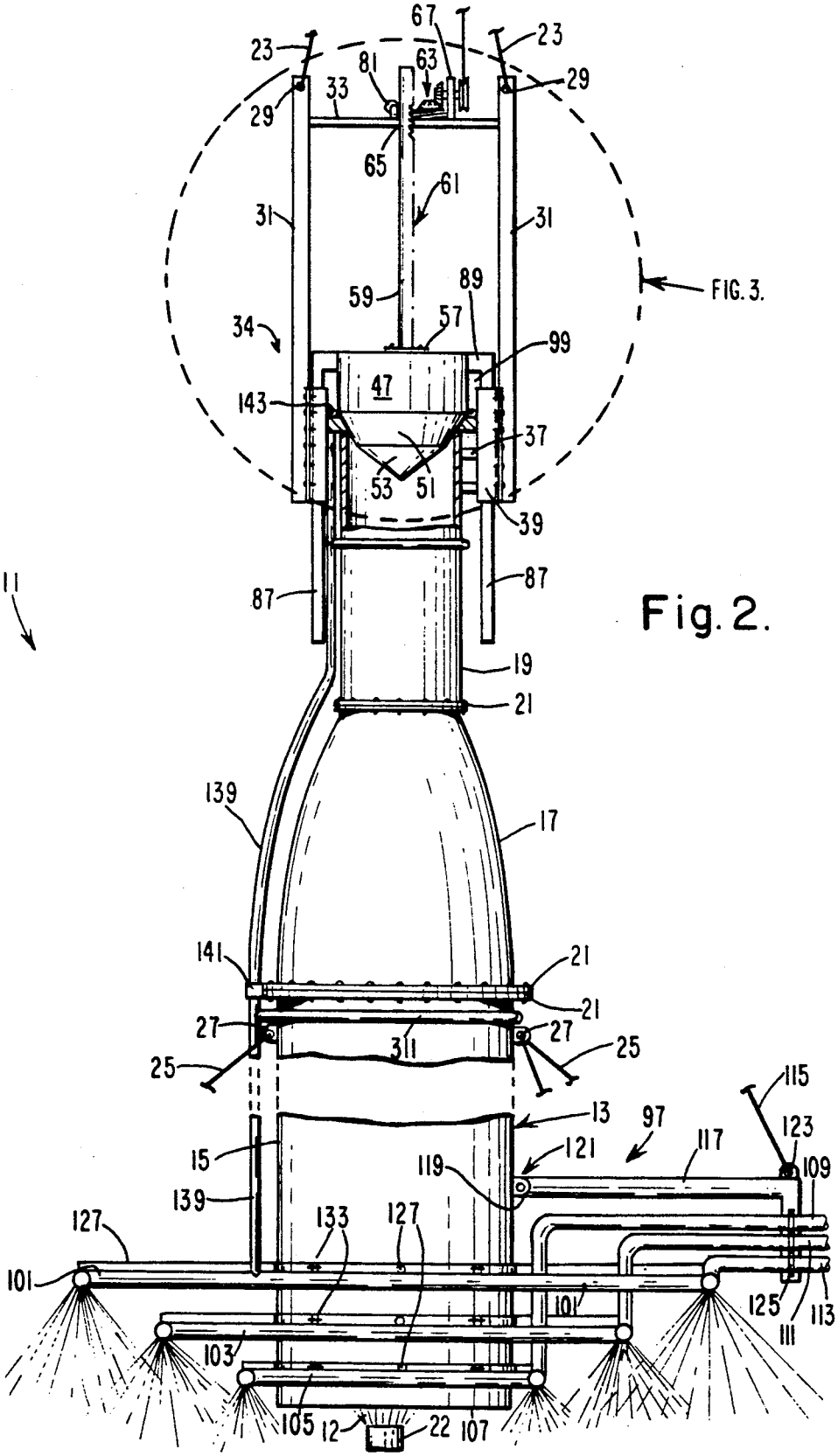
FIG. 2 is an elevational view, partially in section, of the oil well fire extinguishing system of FIG. 1.

Referring now to the drawings and more particularly to FIGS. 1 through 3, there is shown an oil well fire extinguishing system 11 for extinguishing a flaming combustible fluid 12 and having an elongated tubular extinguisher body 13 of steel, for example. In accordance with this embodiment, the body 13 has three distinctive section, namely, a lower, relatively larger diameter section 15, an intermediate transitional gradually tapered section 17, and an upper relatively smaller diameter section 19. As can be seen in FIGS. 1 and 2, the upper end of the intermediate tubular section 17 adjacent the upper section 19 has a diameter that is less than the opposite or lower end thereof adjacent the lower section 15. Although the upper section 19 and the lower section 15 are shown as single sections of tubing, it should be understood that additional lengths of tubing may be coupled by conventional connection means such as flanges, for example, to extend the overall length of each such section.

The adjoining sections 15, 17, and 19 may be joined by conventional circular flanges 21 utilizing conventional nut/bolt, rivet, or welding techniques. Also, in order to stabilize the tubular body 13 in a vertical orientation, once positioned in place of an oil or gas well head 22, by a crane or the like through the use of a conventional steel cable arrangement 23, steel guy cables 25 are deployed and anchored in the surrounding ground, for example, by the use of guy anchor eyes 27.

As can best be seen in FIGS. 2 and 3, the lifting cables 23 are attachable by any conventional means such as shackles, crimped sleeves, U-bolts, and the like, to holes 29 in a pair of vertical solid bars 31 extending a short distance above, and a relatively much longer distance below, a horizontal steel upper plate 33. The attachment between the bars 31 and the circular plate 33 may be made by any conventional means such as welding, for example.

An upper outlet end 34 of the upper tube 19 is an outwardly extending circular lip 35, and welded or otherwise attached at opposite sides of the tube 19 below the lip 35 are vertically aligned pairs of outwardly extending brackets 37 that are each welded, for example, to outwardly extending U-shaped channel members 39. The open end of each channel member 39 is closed along its length by an inner plate member 41 by welding, for example, and outer plates 43 that are welded to each side of associated vertical bar members 31 may be attached by bolts 45 to associated ones of the inner plate members 41. Thus, the upper circular plate 33 and its depending bar members 31 are fixedly attached to the upper portion of the upper tube 19, and the lifting force provided by the cables 23 will extend to and lift the entire tubular body 13.

Disposed above and extendable within the upper end of the upper tube 19 is a complex conical sectioned, valve plug member 47, in this embodiment having an upper circular vertical side portion 49, an intermediate beveled conical section 51, and a lower downwardly-pointing cone portion 53. The plug member 47 may be fabricated in one piece by machining or a casting process, or it may be fabricated in two or three separate sections that are joined permanently together by well known conventional techniques.

Attached by bolts 55, for example, is a plate 57 welded or otherwise attached to a vertically oriented valve bar 59 that is provided with a conventional rack configured side 61 that engages a conventionally designed pinion mechanism 63 mounted on the circular plate 33. The bar 59 extends through a centrally disposed hole 65 in the plate 33, and is capable of lowering and raising the valve plug 47 even under extremely high hydraulic pressure from the combustible fluid 12 such as oil, for example, flowing upwardly from a well head through the tubular body 13.

The pinion mechanism 63 includes a vertical bracket member 67 rotatably supporting an axle 69 to which ends are respectively attached a vertical pinion gear 71 and a pulley wheel 73 that is rotated by linear movement of a conventional steel valve cable 75. The vertically oriented pinion gear 71 engages a horizontally oriented pinion gear 77 that is rotatably mounted on a vertical pin 79 permanently attached to the upper side of the horizontal plate 33. In order to assure constant engagement between the rack and pinion members of the valve plug moving arrangement, a wheel assembly 81 is fixedly mounted on the plate 33 on the side of and in constant rolling engagement with the bar 59 opposite the horizontal pinion gear 77.

In order to stabilize and keep the valve plug member 47 in constant axial alignment with the centerline of the elongated tubular body 13 while moving from its upper "open" position 83 (depicted by dashed outlines) to its lower "closed" position 85, a pair of oppositely disposed, vertically oriented, elongated valve guide arms 87 are fixedly attached by means of horizontally extending short arm sections 89 to opposite sides of the upper section 49 of the valve plug 47. The valve guide arms 87 are aligned with and vertically movable within associated ones of the U-shaped channel members 39.

In its "closed" position 85, the intermediate section 51 of the conical valve plug member 47 sealably engages an appropriately beveled inner valve seat surface 91 of an annular valve seat member 93 that is mounted on top of the lip section 35 of the tube section 19 and held in place by conventional means such as bolts 95, for example. The valve plug and seat members should be fabricated from well known conventional materials such as metals that can withstand the high temperatures that will be experienced from a well fire.

As best seen in FIGS. 1 through 5, the invention also includes a flame inhibiting arrangement basically consisting of a lower ring flame retardant-dispersing assembly 97, and an upper ring flame retardant-dispersing assembly 99.

Figure 4:
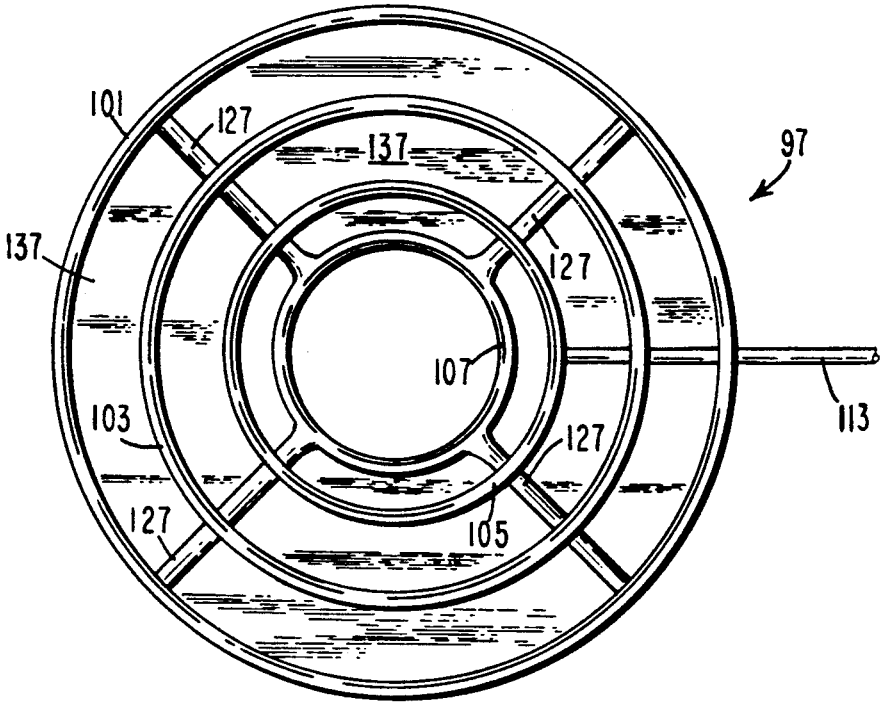
FIG. 4 is a bottom plan view of the oil well fire extinguishing system's lower fire retardant dispersing rings of FIG. 1.
Figure 5:
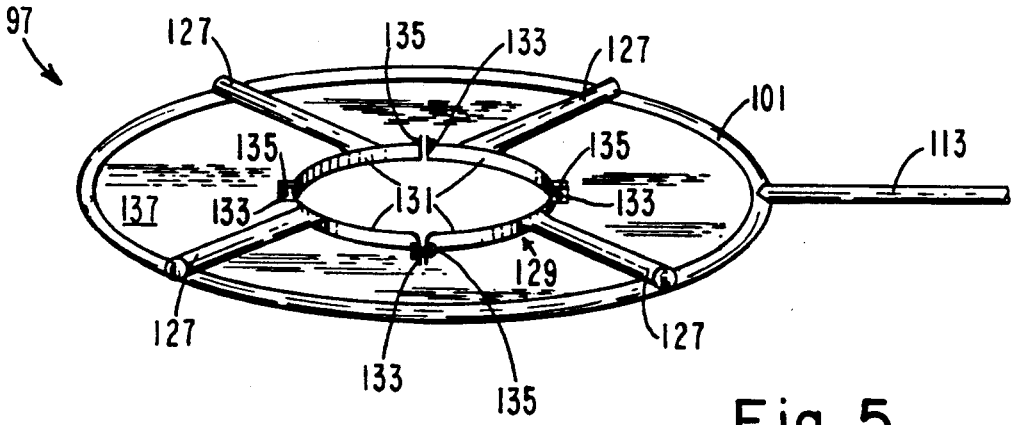
FIG. 5 is a perspective top view of the upper fire retardant dispersing ring shown in FIG. 4.
Figure 9:
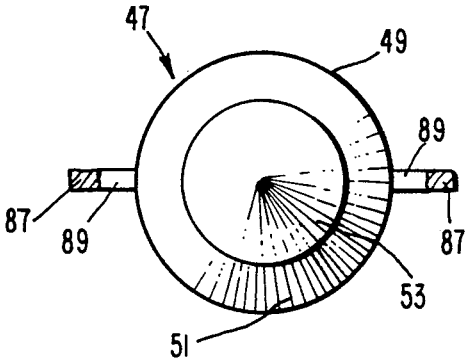
FIG. 9 is a bottom plan view of the valve plug member of FIG. 3.
Figure 9A:
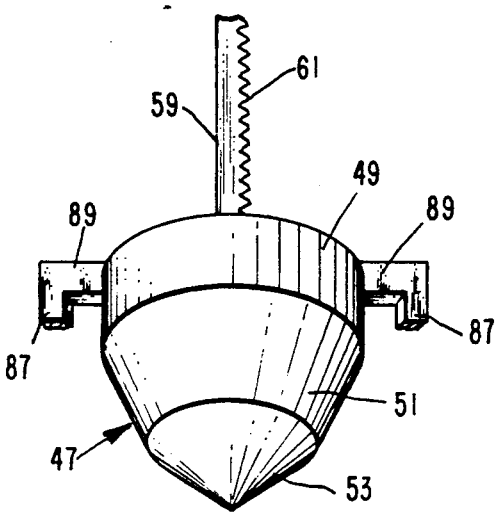
FIG. 9*a* is a perspective view of the valve plug member of FIG. 3.
Figure 10:
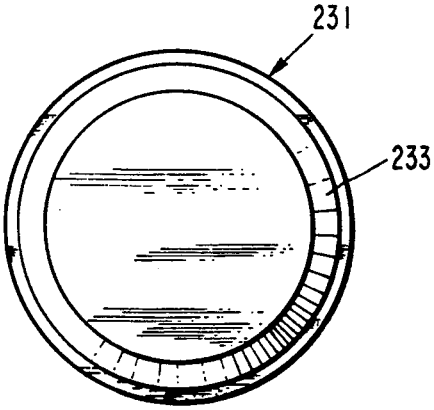
FIG. 10 is a bottom plan view of the valve plug member of FIG. 8.
Figure 10A:
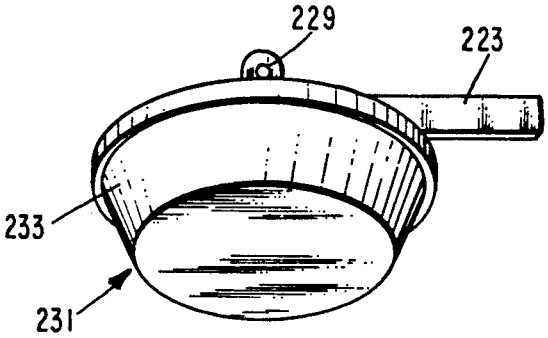
FIG. 10*a* is a perspective view of the valve plug member of FIG. 8.

The lower ring assembly 97, see also FIGS. 4 and 5, consists of three coaxially aligned circular nozzle structure or rings 101, 103, and 105, disposed in spaced parallel planes adjacent to a lower inlet end 107 of the lower tubular body section 15. Each ring is fed by associated feed pipes 109, 111, and 113, which may be supported in a horizontal orientation by a steel cable 115 anchored to one of the anchor eyes 27.

This arrangement may be best implemented by the use of a horizontally extending arm 117 movably attached at its inner end 119 by a pivot pin arrangement 121 to the side of the lower tube section 15, and to the support cable 115 by means of an eye 123 at the outer end of the arm 117. A conventional metal strap arrangement 125 may be used to hold all three feed pipes 109, 111 and 113, Each ring assembly is supported in a different horizontal plane by four sets of radially extending arms 127 each anchored by a band assembly 129 attached to the outer surface of the lower tubular member 15 by any conventional means such as, for example, four curved strips 131 clamped together at their outwardly extending tab ends 133 by bolt assemblies 135 (FIG 5). The upper ring assembly 101 also preferably supports a metal sheet (or assembly of connected metal sheets) 137 that acts as a cover or hat or lid. For the sake of clarity, the arms 127 and the sheet 137 is not shown in place in FIG. 1.

In accordance with the first embodiment of the present invention, the upper ring assembly 99 consists of a vertical feed pipe 139 which may be supported by clamp members 141 attached to the various sections of the tubular body 13 at the flange sections 21, for example. The lower end of the feed pipe 139 couples to any of the lower circular rings, such as ring 101, and the upper end of the pipe 139 couples to an upper ring 143. Thus, fluid under pressure in the lower ring 101 will be transported upwardly to the upper ring assembly 99 through the vertical feed pipe 139.

The entire lower half surface of each of the lower rings 101, 103, and 105 are provided with a nozzle orifice pattern consisting of a plurality of orifices 145 that are adapted to spray outwardly and basically downwardly the liquid or gas media disposed under pressure in the rings through the feed pipes. This feature of the invention is best seen in FIGS. 6 and 7.

The upper ring 143 is also provided with orifices 145, but the orifice pattern is oriented so that the gas or fluid under pressure exiting the orifices will spray toward the area around the seal surface between the valve plug 47 and the valve seat 93. Although not shown in FIGS. 1 and 2, for the sake of clarity, the orifices 145 provide a uniform spray pattern, as shown in FIG. 7, looking at any cross section of a circular ring.

In operation, the tubular body 11, along with the upper valve arrangement and the upper and lower rings, are lifted by means of a crane, or the like, using the cable arrangement 23, and swung over a flaming well site. The valve plug 47 is now in its upper, "open" position so that as the tubular assembly is lowered over the well site, the oil or gas under high pressure will flow in an unimpeded manner upwardly through the length of the tubular body 11.

Once in place with the lower end 107 of the tubular lower section 15 resting on a well platform or the ground, the guy cables 25 are extended radially outwardly and anchored to appropriately positioned anchors such as "dead men", for example.

Depending upon the circumstances, the guying may take place either before or after fire retardant or oxygen inhibiting fluid or gas (arrow 147) is forced under pressure from conventional pump or pumps (not shown) through the feed pipes 109, 111, and 113, to the associated lower and upper rings and sprayed outwardly through the orifices 145. Preferably, the dimensions of the orifices are such that the emitted material will be atomized for maximum effectiveness to terminate and/or inhibit the combustion of the hydrocarbon products emanating from the well casing or head 22.

As any fire located at the lower area of the invention 11 is extinguished and prevented from re-igniting by the operation described above, the valve cable 75 is linearly moved by a conventional arrangement at the top of a crane's boom, for example, so as to cause the rack and pinion assembly 63 to rotated and force the conical plug member 47 downwardly against the upward force of the gushing oil or gas from the well head. As this is occurring, the upper ring arrangement 99, disposed about the valve seat 93, is spraying the fire inhibiting material to first quell and then prevent further combustion of any hydrocarbon product in the area of the valve seat. Thus, once the plug 47 is seated in the valve seat to force the gas or oil back down the inside of the tubular body 13, no combustion can occur at either the upper valve area or at the lower tubular end area.

It should be noted that the vertical, downwardly extending arm members 87 maintain the valve plug 47 in proper register and alignment with the annular valve seat 93 since the arm members 87 are guided by the rigid channel opening provided by the U-shaped channel member 39 and the inner channel-closing plate 41.

In accordance with another embodiment of the invention that is useable in oil and gas well fire situations where the well pressure is not so extreme, an alternate valve assembly 211 is shown in FIG. 8. Here, an annular valve seat member 213 is fixedly mounted at the upper end 215 of the upper tubular member 19', and an outwardly extending bracket member 217 is welded to the member 19' adjacent the end 215 and provided with a pin-accepting hole (not shown) at its outer end to hold a pivot pin 219 extending through a pivot arm section 221 of a flap valve pivot assembly 223.

The assembly 223 also includes a transverse member 225 that has eyelet holes 227 at an outer end, and 229 at an inner end. Also at the inner end of the member 225 is disposed a circular flapper valve lid member 231 that has a conical section seating surface 233 that is adapted to sealably fit into a mating inclined circular seating surface 235 of the valve seat member 213 when the member 223 is in its horizontal or "closed" position.

A first valve cable 237 is attached to the outer eyelet hole 227, and a second valve cable 239 is attached to the inner eyelet hole 229. In operation, upward tension is produced by any conventional means to the first valve cable 237 while slack is provided to the other valve cable 239. Such action causes the assembly 223 to pivot on the pin 219 from an "open" vertical position (dashed outline) to a horizontal "closed" position (solid outline). A cable-clearance wheel 241 is mounted on and above the outer end of the transverse member 225 so that the first valve cable 237 is moved outwardly when the transverse member is pivoted from its horizontal position to its vertical position, in order to prevent the cable from contacting and possibly interfering with the operation of the valve assembly. The valve is moved to its "open" position by reversing the tension on the two cables.

According to still another embodiment of the present invention, additional nozzle rings 311 are disposed between the upper ring 143 and the lower rings 101, 103, and 105 in order to provide additional protection against unintended ignition of any hydrocarbon product that may be in the area. An additional atomizer ring may best be viewed in FIG. 2.

In accordance with yet another embodiment of the present invention, one or more of the lower rings, other than the one feeding the vertical pipe leading to the upper circular ring, or an additional lower ring (not shown) may be fed with a cement-like non-flammable material under pressure that will build up a wall around the base of the tubular structure to additionally seal this area off from any oxygen or like flame-supporting gas or fluid.

The flame retardant material described in this specification may be any conventional liquid or gas chemical such as carbon dioxide, nitrogen, helium, and many others known in the art to inhibit flame support and/or ignition. In this regard, the ramifications of the use of water or a water-based chemical formulation in the operation of this invention should be carefully considered.

From the foregoing, it should be obvious that there has herein been described a new and improved oil and gas well fire extinguishing system that is easily constructed, economical to build, easy to transport, assemble and operate, and very quick and effective in function. Although several embodiments of the invention have been described in detail, it should be understood that additional embodiments and arrangements can be readily devised by those skilled in the art without departing from the scope of the invention.

What is claimed is:

1. An extinguisher system for extinguishing flames from combustible fluid exiting from a pipe, the system comprising:

an elongated tubular extinguisher body disposable over the combustible fluid emitting pipe, said extinguisher body having a lower inlet end and an upper outlet end and adapted to accommodate an entire flow of the combustible fluid exiting from the pipe through said extinguisher body;

valve means mounted in said extinguisher body adjacent said upper outlet end for eliminating the flow of the combustible fluid exiting from the pipe through said extinguisher body; and flame inhibiting means including circular nozzle structures disposed adjacent said lower inlet end and adjacent said valve means externally of said extinguisher body for preventing combustion of the combustible fluid adjacent said extinguisher body's lower inlet end and adjacent said valve means.

2. The extinguisher system according to claim 1, wherein said elongated tubular extinguisher body includes a plurality of axially aligned and adjacent tubular body sections.

3. The extinguisher system according to claim 2, wherein an intermediate one of said tubular body sections is a gradually tapered tubular section having an upper end and a lower end, said upper end of said gradually tapered tubular section having a diameter less than that of said lower end thereof.

4. The extinguisher system according to claim 2, wherein those of said tubular body sections adjacent others of said tubular body sections include outwardly extending flanges, and also comprising attached means associated with said flanges for fixedly joining adjacent ones of said tubular body sections.

5. The extinguisher system according to claim 1, wherein said elongated tubular extinguisher body includes means for anchoring said tubular body fixedly in place over the combustible fluid emitting pipe.

6. The extinguisher system according to claim 1, wherein said elongated tubular extinguisher body includes lifting means for lifting and lowering said tubular body.

7. The extinguisher system according to claim 6, wherein said lifting means includes a steel cable arrangement.

8. The extinguisher system according to claim 1, wherein said valve means includes an annular valve seat member attached at said upper outlet end of said extinguisher body, and an axially movable valve plug member seatable in said valve seat member.

9. The extinguisher system according to claim 8, wherein said valve seat member and said valve plug member have mating inclined surfaces.

10. The extinguisher system according to claim 9, wherein said valve means includes valve plug stabilizing means for maintaining axial alignment of said valve plug member as it moves along axis thereof.

11. The extinguisher system according to claim 10, wherein said valve plug stabilizing means includes oppositely disposed valve plug stabilizing arms extending downwardly along side said valve plug member, and oppositely disposed stabilizing arm accepting guide members attached adjacent said upper outlet end of said extinguisher body and slidably guiding associated ones of said valve plug stabilizing arms therein.

12. The extinguisher system according to claim 8, wherein said valve plug member includes a lower cone portion, an intermediate conical section portion, and an upper circular vertical side wall portion.

13. The extinguisher system according to claim 8, wherein said valve means also includes valve actuating means for lowering and raising said valve plug member.

14. The extinguisher system according to claim 13, wherein said valve actuating means includes a pinion mechanism mounted above said upper outlet end of said tubular body, said pinion mechanism includes an axial rack member having upper and lower ends, said lower end of said rack member being attached centrally to said circular valve plug member while said upper end of said rack member being engaged with said pinion mechanism.

15. The extinguisher system according to claim 14, wherein said valve actuating means also includes a remotely-operated cable arrangement coupled to said pinion mechanism for moving said valve plug member along a vertical axis.

16. The extinguisher system according to claim 1, wherein said valve means includes a flapper valve assembly having an annular flapper valve seat member attached at said upper outlet end of said extinguisher body, and a pivotally movable circular flapper valve lid member seatable in said flapper valve seat member.

17. The extinguisher system according to claim 1, wherein said flame inhibiting means further includes orifices in an annular surface of each of said circular nozzle structures.

18. The extinguisher system according to claim 17, wherein one of said circular nozzle structures is disposed immediately adjacent said valve means, and the other of said circular nozzle structures is disposed adjacent said lower inlet end of said extinguisher body.

19. The extinguisher system according to claim 18, wherein said flame inhibiting means also includes a fluid conduit member coupling any fluid under pressure present in said other of said circular nozzle structures to said one of said circular nozzle structures.

20. The extinguisher system according to claim 19, wherein said flame inhibiting means further includes at least one additional circular nozzle structure disposed below said valve means and above said other of said nozzle structures and coupled to said fluid conduit member.

21. The extinguisher system according to claim 18, wherein each of said circular nozzle structures is coupled to a pressurized fluid-carrying feed pipe.

22. The extinguisher system according to claim 17, wherein said orifices are disposed in a pattern and have a dimension to cause atomized spray from around each of said circular nozzle structures in a predetermined uniform pattern.

* * * * *